US007431561B2

(12) United States Patent
Hooper et al.

(10) Patent No.: US 7,431,561 B2
(45) Date of Patent: Oct. 7, 2008

(54) METHOD AND APPARATUS FOR COOLING GAS TURBINE ROTOR BLADES

(75) Inventors: Tyler F. Hooper, Amesbury, MA (US); Bhanu Reddy, Boxford, MA (US); Gaoqiu Zhu, Billerica, MA (US); Richard William Albrecht, Jr., Fairfield, OH (US)

(73) Assignee: General Electric Company, Schenectady, NY (US)

( * ) Notice: Subject to any disclaimer, the term of this patent is extended or adjusted under 35 U.S.C. 154(b) by 72 days.

(21) Appl. No.: 11/356,388

(22) Filed: Feb. 16, 2006

(65) Prior Publication Data

US 2007/0189898 A1 Aug. 16, 2007

(51) Int. Cl.
*F01D 5/18* (2006.01)

(52) U.S. Cl. ..... 416/96 R; 416/97 R

(58) Field of Classification Search ..... 416/90 R, 416/96 R, 97 R

See application file for complete search history.

(56) References Cited

U.S. PATENT DOCUMENTS 4,775,296 A * 10/1988 Schwarzmann et al. ... 416/97 R
5,660,524 A 8/1997 Lee et al.
6,062,817 A * 5/2000 Danowski et al. ..... 416/97 R
6,126,396 A 10/2000 Doughty et al.
6,220,817 B1 4/2001 Durgin et al.
6,347,923 B1 2/2002 Semmler et al.
6,471,479 B2 10/2002 Starkweather
6,491,496 B2 12/2002 Starkweather
6,561,758 B2 5/2003 Rinck et al.
6,955,523 B2 10/2005 McClelland
6,960,060 B2 11/2005 Lee
6,981,742 B1 1/2006 Hsiao

* cited by examiner

*Primary Examiner*—Edward Look
*Assistant Examiner*—Dwayne J White
(74) *Attorney, Agent, or Firm*—WIlliam Scott Andes, Esq.; Armstrong Teasdale LLP

(57) ABSTRACT

Methods and apparatus for cooling gas turbine rotor blades is provided. The blade includes an airfoil having an internal three pass serpentine cooling circuit having radially extending first, second, and third serpentine cooling cavities partially separated by, in axially aft succession, a first radially extending internal rib and a second radially extending internal rib. The serpentine cooling circuit includes a first inlet in flow communication with the first cavity and a second inlet in flow communication with at least one of the second and third cavities wherein the first and second inlets are formed during casting of the airfoil.

18 Claims, 3 Drawing Sheets

METHOD AND APPARATUS FOR COOLING GAS TURBINE ROTOR BLADES

BACKGROUND OF THE INVENTION

This invention relates generally to gas turbine engines and more particularly, to methods and apparatus for cooling gas turbine engine rotor assemblies.

Turbine rotor assemblies typically include at least one row of circumferentially-spaced rotor blades. Each rotor blade includes an airfoil that includes a pressure side, and a suction side connected together at leading and trailing edges. Each airfoil extends radially outward from a rotor blade platform. Each rotor blade also includes a dovetail that extends radially inward from a shank extending between the platform and the dovetail. The dovetail is used to mount the rotor blade within the rotor assembly to a rotor disk or spool. Known blades are hollow such that an internal cooling cavity is defined at least partially by the airfoil, platform, shank, and dovetail.

At least some known high pressure turbine blades include an internal cooling cavity that is serpentine such that a path of cooling gas is channeled radially outward to the blade tip where the flow reverses direction and flows back radially inwardly toward the blade root. The flow may exit the blade through the root or the flow may be directed to holes in the trailing edge to permit the gas to flow across a surface of the trailing edge for cooling the trailing edge. To improve cooling efficiency a refresher hole is drilled through the root to permit new flow of the gas to enter the blade and intersect the root turn of a serpentine passage. The refresher holes are of a relatively small diameter such that the gases passes through the holes are raised in temperature due to high velocity. Refresher holes are sized to a relatively small diameter to meter the amount of mixed gas. Drilling the holes adds an extra operation during the manufacturing process that is expensive and labor intensive.

BRIEF DESCRIPTION OF THE INVENTION

In one embodiment, a gas turbine rotor blade includes an airfoil having an internal three pass serpentine cooling circuit having radially extending first, second, and third serpentine cooling cavities partially separated by, in axially aft succession, a first radially extending internal rib and a second radially extending internal rib. The serpentine cooling circuit includes a first inlet in flow communication with the first cavity and a second inlet in flow communication with at least one of the second and third cavities wherein the first and second inlets are formed during casting of the airfoil.

In another embodiment, a method for cooling a gas turbine engine turbine blade wherein the turbine blade includes a serpentine cooling circuit extending between a dovetail of the blade and a tip of the blade and a flow metering device coupled to the dovetail. The method includes providing a first flow of a cooling gas to the blade through a first cooling inlet, providing a second flow of a cooling gas to the blade through a second cooling inlet, and controlling the cooling gas flow through the first and second cooling inlets using the flow metering device.

In yet another embodiment, a gas turbine engine assembly includes a compressor, a combustor, and a turbine coupled to the compressor. The turbine includes an airfoil having an internal three pass serpentine cooling circuit having radially extending first, second, and third serpentine cooling cavities partially separated by, in axially aft succession, a first radially extending internal rib and a second radially extending internal rib. The serpentine cooling circuit including a first inlet in flow communication with the first cavity and a second inlet in flow communication with at least one of the second and third cavities wherein the first and second inlets are formed during casting of the airfoil.

DETAILED DESCRIPTION OF THE INVENTION

Figure 1:
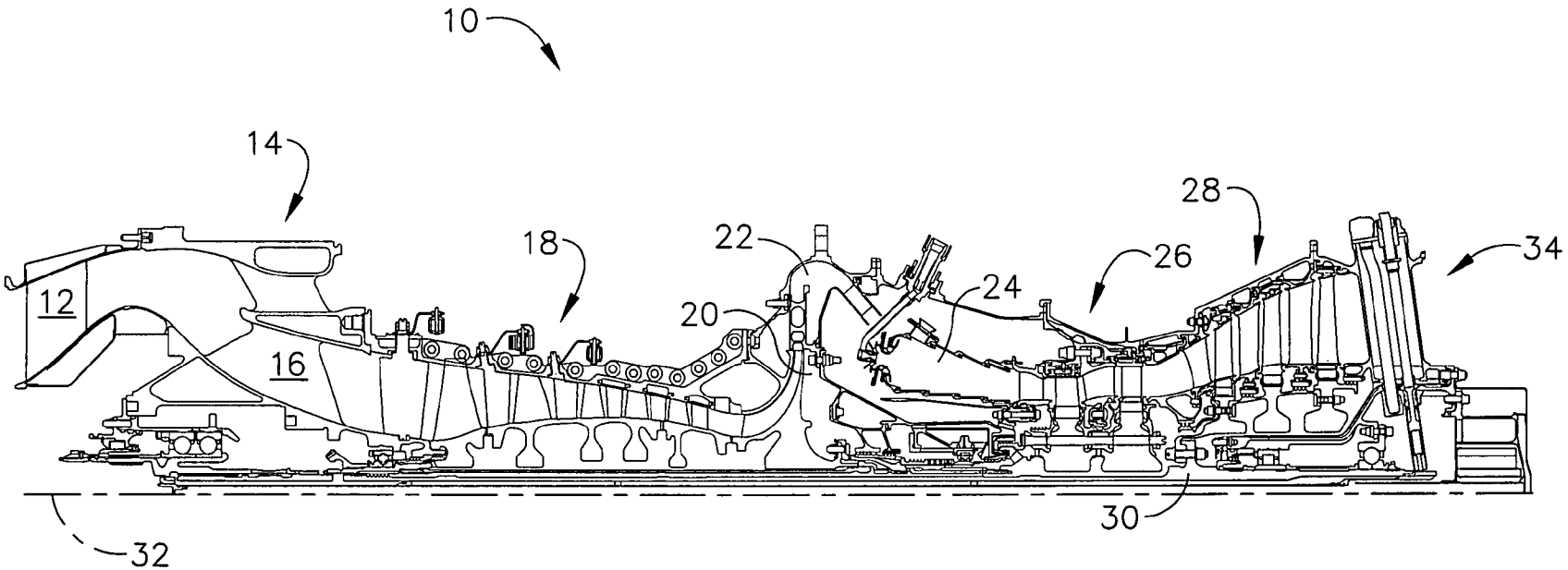
FIG. 1 is a schematic illustration of an exemplary gas turbine engine.

FIG. 1 is a schematic cross-sectional illustration of a gas turbine engine 10 including an inlet 12, an inlet particle separator 14, core inlet guide vanes 16. Engine 10 also includes in serial flow communication an axial compressor 18, a radial compressor 20 or impellor, and a deswirler diffuser 22. Downstream from deswirler diffuser 22 is a combustor 24, a high pressure turbine 26 and a power turbine 28.

In operation, air flows through inlet 12 to axial compressor 18 and to radial compressor 20. The highly compressed air is delivered to combustor 24. The combustion exit gases are delivered from combustor 24 to high pressure turbine 26 and power turbine 28. Flow from combustor 24 drives high pressure turbine 26 and power turbine 28 coupled to a rotatable main turbine shaft 30 aligned with a longitudinal axis 32 of gas turbine engine 10 in an axial direction and exits gas turbine engine 10 through an exhaust system 34.

Figure 2:
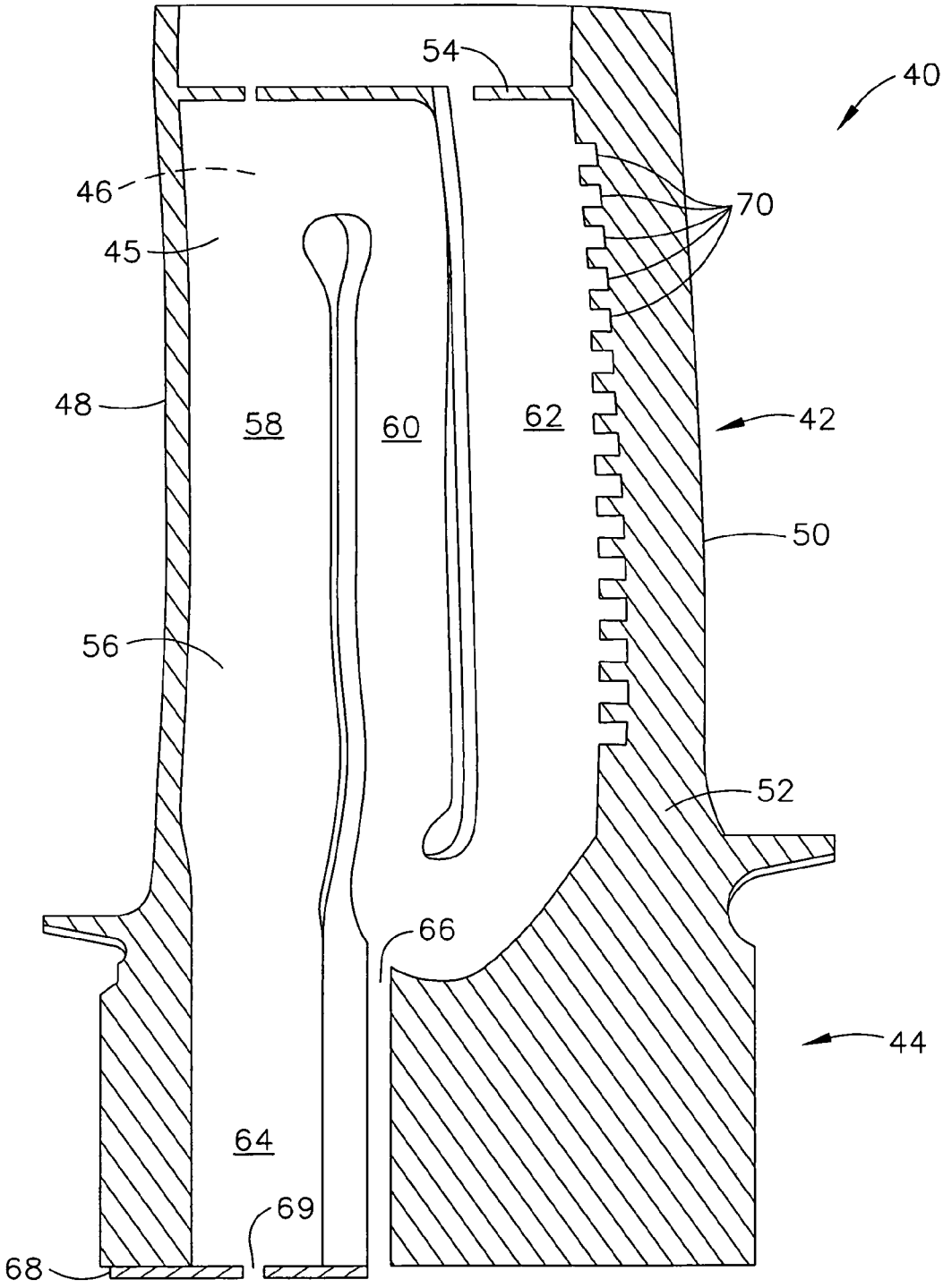
FIG. 2 (PRIOR ART)
FIG. 2 is a perspective internal schematic illustration of a known rotor blade that may be used with the gas turbine engine shown in FIG. 1.

FIG. 2 is a perspective internal schematic illustration of a known rotor blade 40 that may be used with gas turbine engine 10 (shown in FIG. 1). In an exemplary embodiment, a plurality of rotor blades 40 form a high pressure turbine rotor blade stage (not shown) of gas turbine engine 10. Each rotor blade 40 includes a hollow airfoil 42 and an integral dovetail 44 used for mounting airfoil 42 to a rotor disk (not shown) in a known manner.

Airfoil 42 includes a first sidewall 45 (shown cutaway) and a second sidewall 46. First sidewall 45 is convex and defines a suction side of airfoil 42, and second sidewall 46 is concave and defines a pressure side of airfoil 42. Sidewalls 45 and 46 are connected at a leading edge 48 and at an axially-spaced trailing edge 50 of airfoil 42 that is downstream from leading edge 48.

First and second sidewalls 45 and 46, respectively, extend longitudinally or radially outward to span from a blade root 52 positioned adjacent dovetail 44 to a tip plate 54 which defines a radially outer boundary of an internal cooling chamber 56. Cooling chamber 56 is defined within airfoil 42 between sidewalls 45 and 46. In the exemplary embodiment, cooling chamber 56 includes a serpentine passage comprising a first cavity 58, a second cavity 60 and a third cavity 62 cooled with compressor bleed air. An inlet passage 64 is configured to channel air into first cavity 58 and then into second cavity 60. A refresher hole 66 couples second cavity 60 to the compressor bleed air. Refresher hole 66 is formed using an electrical discharge machining (EDM) process that generates stress concentration at the sharp edge surrounding the openings of refresher hole 66 and generates recast layer/micro-cracks associated with the EDM process. A downstream end of third cavity 62 is in flow communication with a plurality of trailing edge holes 70 which extend longitudinally (axially) along trailing edge 50. Particularly, trailing edge holes 70 extend along pressure side wall 46 to trailing edge 50.

In operation, cooling air is supplied to blade 40 from compressor bleed air through inlet 64 and refresher hole 66. Air entering blade 40 through inlet 64 is directed through first cavity 58 and into second cavity 60. Refresher hole 66 permits cooler compressor bleed air to enter chamber 56 between second cavity 60 and third cavity 62. The cooler air reduces the temperature and increases the pressure of the air entering third cavity 62. The cooler air and increased pressure facilitate cooling trailing edge 50 through holes 70. Air entering first cavity 58 is metered using a meter plate 68, which includes a hole 69 of a predetermined size. The flow and pressure in first cavity 58 is adjusted by grinding metering plate 68 from dovetail 44 and installing a new metering plate 68 with a different diameter hole 69. The flow and pressure in third cavity 62 is adjusted by modifying the size of hole 66. However, the velocity of the air passing through hole 66 is relativity high causing the air temperature of the air entering third cavity 62 to be higher than the temperature of the air entering hole 66 such that a cooling efficiency of the refresher air is less than optimal.

Figure 3:
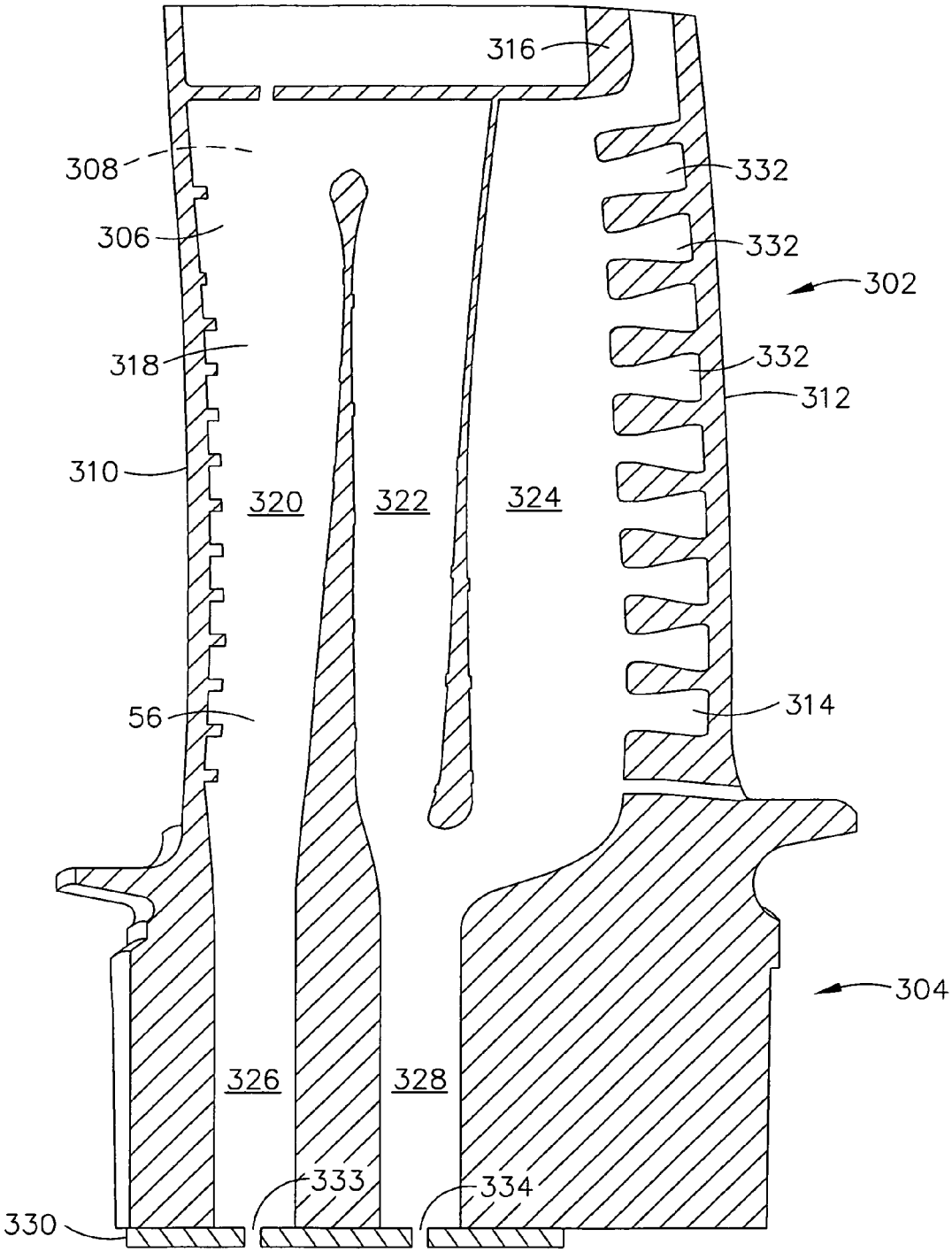
FIG. 3 is a perspective internal schematic illustration of a rotor blade in accordance with an exemplary embodiment of the present invention.

FIG. 3 is a perspective internal schematic illustration of a rotor blade 300 in accordance with an exemplary embodiment of the present invention. Blade 300 includes a hollow airfoil 302 and an integral dovetail 304 used for mounting airfoil 302 to a rotor disk (not shown).

Airfoil 302 includes a first sidewall 306 (shown cutaway) and a second sidewall 308. First sidewall 306 is convex and defines a suction side of airfoil 302, and second sidewall 308 is concave and defines a pressure side of airfoil 302. Sidewalls 306 and 308 are connected at a leading edge 310 and at an axially-spaced trailing edge 312 of airfoil 302 that is downstream from leading edge 310.

First and second sidewalls 306 and 308, respectively, extend longitudinally or radially outward to span from a blade root 314 positioned adjacent dovetail 44 to a tip plate 316 which defines a radially outer boundary of an internal cooling chamber 318. Cooling chamber 318 is defined within airfoil 302 between sidewalls 306 and 308. In the exemplary embodiment, cooling chamber 318 includes a serpentine passage comprising a first cavity 320, a second cavity 322 and a third cavity 324 cooled with compressor bleed air. An inlet passage 326 is configured to channel air into first cavity 320 and then into second cavity 322. A refresher inlet 328 couples second cavity 322 to the compressor bleed air. A downstream end of third cavity 324 is in flow communication with a plurality of trailing edge slots 332 which extend longitudinally (axially) along trailing edge 312. Particularly, trailing edge slots 332 extend along pressure side wall 308 to trailing edge 312.

In the exemplary embodiment, both inlet 326 and refresher inlet 328 are formed during the casting process of blade 300. The ceramic core used to cast blade 300 includes a tab that extends through the passages where inlet 326 and refresher inlet 328 are formed. The tabs are used to secure the core in the casting mold. Using two tabs permits a more secure connection than is available using only one tab through the inlet passage in the prior art blade. Additionally, trailing edge slots 332 are also cast rather than drilled, as in the prior art blade. Each of the slots also include a tab extending from the casting mold and are used to further secure the ceramic core during casting.

In operation, cooling air is supplied to blade 300 from compressor bleed air through inlet 326 and refresher inlet 328. Air entering blade 300 through inlet 326 is directed through first cavity 320 and into second cavity 322. Refresher inlet 328 permits cooler compressor bleed air to enter chamber 318 between second cavity 322 and third cavity 324. The cooler air reduces the temperature and increases the pressure of the air entering third cavity 324. The cooler air and increased pressure facilitate cooling trailing edge 312 through slots 332. Air entering first cavity 320 is metered using a metering plate 330, which includes a first hole 333 of a predetermined size. Metering plate 330 includes a second hole 334 of a predetermined size to control the floe of refresher air through refresher inlet 328. The flow and pressure in cooling chamber 318 is adjusted by grinding metering plate 330 from dovetail 44 and installing a new metering plate 330 with a different diameter holes 333 and 334. The velocity of the air passing through refresher inlet 328 is reduced with respect to the velocity of the air passing through hole 66 of the prior art blade 40. Because the velocity is less the temperature raise of the air entering third cavity 324 is less such that a cooling efficiency of the refresher air is facilitated being optimal.

The above-described cast refresher flow passage is a cost-effective and highly reliable method for reducing a temperature rise of the cooling air due to lower Mach numbers resulting in improved airfoil cooling efficiency, eliminating stress concentration from sharp edge of the machined refresher hole and eliminating the recast layer/micro-cracks associated with EDM, improved core support during the casting process, eliminating long EDM hole machining. The above described method also produces less scrap. The prior art design blade is scrapped if the refresher hole is oversized. A blade fabricated using the method described above is corrected for an oversized refresher hole by grinding off the metering plate and replacing it with a new one. Further, flow splits between the inlet and refresher inlet can be adjusted using the metering plate holes. Accordingly, the cast refresher flow passage assembly facilitates operating gas turbine engine components, in a cost-effective and reliable manner.

While the invention has been described in terms of various specific embodiments, those skilled in the art will recognize that the invention can be practiced with modification within the spirit and scope of the claims.

What is claimed is:

1. A blade for a gas turbine, said blade comprising an airfoil having an internal three pass serpentine cooling circuit having radially extending first, second, and third serpentine cooling cavities partially separated by, in axially aft succession, a first radially extending internal rib and a second radially extending internal rib, said serpentine cooling circuit including a first inlet in flow communication with said first cavity and a second inlet in flow communication with said second and third cavities, said second inlet comprising a first opening, said blade comprising a dovetail and a metering plate coupled to said dovetail, said metering plate comprising a first and second hole, said first opening has a first diameter and said first hole has a second diameter, said first diameter is larger than said second diameter, wherein said first and second inlets are formed during casting of the airfoil.

2. A blade in accordance with claim 1 further comprising a plurality of cooling slots longitudinally spaced apart along a trailing edge of the airfoil, said cooling slots arranged in a column extending through a first sidewall of the airfoil, said slots in flow communication with said third cooling cavity and arranged along said trailing edge.

3. A blade in accordance with claim 1 wherein said trailing edge cooling slots are formed during casting of the airfoil.

4. A blade in accordance with claim 1 wherein said dovetail is coupled to a radially inner root portion of the airfoil, said metering plate is configured to control gas flowing through the first and second inlets to a respective predetermined rate.

5. A blade in accordance with claim 4 wherein said metering plate first hole is aligned with said first opening in the dovetail and is in flow communication with at least one of said second cavity and said third cavity, said second hole is aligned with a second opening in the dovetail in flow communication with said first cavity.

6. A blade in accordance with claim 1 wherein said trailing edge cooling slots are configured to generate a gaseous film over at least a portion of the trailing edge such that the trailing edge is facilitated being cooled by the film.

7. A method for cooling a gas turbine engine turbine blade wherein the turbine blade includes a serpentine cooling circuit extending between a dovetail of the blade and a tip of the blade and a flow metering device coupled to the dovetail, said method comprising:

providing a first flow of a cooling gas to the blade through a first cooling inlet in flow communication with a first cavity;

providing a second flow of a cooling gas to the blade through a second cooling inlet in flow communication with a second and third cavity;

forming a first opening in the second cooling inlet and a first and second hole within the metering device, wherein the first opening has a first diameter and the first hole has a second diameter, wherein the first diameter is larger than the second diameter, and controlling the cooling gas flow through the first and second cooling inlets using the flow metering device.

8. A method in accordance with claim 7 wherein providing a first flow of a cooling gas to the blade through a first cooling inlet comprises providing a first flow of a cooling gas to a first cavity of the serpentine cooling circuit.

9. A method in accordance with claim 7 wherein providing a second flow of a cooling gas to the blade through a second cooling inlet comprises providing a second flow of a cooling gas to at least one of a second cavity and a third cavity of the serpentine cooling circuit wherein the second and third cavities are separated by a bend in the serpentine cooling circuit.

10. A method in accordance with claim 9 wherein providing a second flow of a cooling gas to the blade through a second cooling inlet comprises providing a second flow of a cooling gas to the bend.

11. A method in accordance with claim 7 further comprising reducing the temperature of the first flow using the second flow.

12. A method in accordance with claim 7 wherein the blade includes a plurality of trailing edge slots in flow communication with the serpentine cooling circuit, said method further comprising controlling a pressure inside the serpentine cooling circuit using the first and second flows and a cross-sectional area of the trailing edge slots.

13. A gas turbine engine assembly comprising:

a compressor;

a combustor; and a turbine coupled to said compressor said turbine comprising an airfoil having an internal three pass serpentine cooling circuit having radially extending first, second, and third serpentine cooling cavities partially separated by, in axially aft succession, a first radially extending internal rib and a second radially extending internal rib, said serpentine cooling circuit including a first inlet in flow communication with said first cavity and a second inlet in flow communication with said second and third cavities, said second inlet comprises a first opening, said turbine further comprises a dovetail extending radially inward from said airfoil and a metering plate coupled to said dovetail, said metering plate comprising a first and second hole, wherein said first opening has a first diameter and said first hole has a second diameter, said first diameter is larger than said second diameter, wherein said first and second inlets are formed during casting of the airfoil.

14. A gas turbine engine assembly in accordance with claim 13 further comprising a plurality of cooling slots longitudinally spaced apart along a trailing edge of the airfoil, said cooling slots arranged in a column extending through a first sidewall of the airfoil, said slots in flow communication with said third cooling cavity and arranged along said trailing edge.

15. A gas turbine engine assembly in accordance with claim 13 wherein said trailing edge cooling slots are formed during casting of the airfoil.

16. A gas turbine engine assembly in accordance with claim 13 wherein said dovetail is coupled to a radially inner root portion of the airfoil, said a metering plate configured to control gas flowing through the first and second inlets to a respective predetermined rate.

17. A gas turbine engine assembly in accordance with claim 16 wherein said metering plate first hole is aligned with said first opening in the dovetail in flow communication with at least one of said second cavity and said third cavity, said second hole is aligned with a second opening in the dovetail in flow communication with said first cavity.

18. A gas turbine engine assembly in accordance with claim 13 wherein said trailing edge cooling slots are configured to generate a gaseous film over at least a portion of the trailing edge such that the trailing edge is facilitated being cooled by the film.

* * * * *